US010349750B2

(12) United States Patent
Porter

(10) Patent No.: US 10,349,750 B2
(45) **Date of Patent: *Jul. 16, 2019**

(54) FURNITURE OBJECTS FOR STORING FOLDABLE BEDS

(71) Applicant: Night and Day Furniture LLC, Vancouver, WA (US)

(72) Inventor: Howard Porter, Kuala Lumpur (MY)

(73) Assignee: Night and Day Furniture, LLC, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/983,347

(22) Filed: May 18, 2018

(65) Prior Publication Data

US 2018/0263374 A1 Sep. 20, 2018

Related U.S. Application Data

(63) Continuation of application No. 14/809,736, filed on Jul. 27, 2015, now Pat. No. 9,993,088.

(60) Provisional application No. 61/999,876, filed on Aug. 8, 2014.

(51) Int. Cl.

| | |
|---|---|
| ***A47C 17/52*** | (2006.01) |
| ***A47C 17/56*** | (2006.01) |
| ***A47C 17/58*** | (2006.01) |
| ***A47C 19/12*** | (2006.01) |

(52) U.S. Cl.

CPC ..... *A47C 17/58* (2013.01); *A47C 19/12* (2013.01)

(58) Field of Classification Search

CPC ..... A47C 17/48–62; A47C 19/12

See application file for complete search history.

(56) References Cited

U.S. PATENT DOCUMENTS

| | | | |
|---|---|---|---|
| 93,556 | A | 8/1869 | Robinson |
| 157,719 | A | 12/1874 | Iverson |
| 179,013 | A | 6/1876 | Green |
| 189,303 | A | 4/1877 | Crosby |
| 215,134 | A | 5/1879 | Kiss |
| 218,678 | A | 8/1879 | Koskul |
| 225,393 | A | 3/1880 | Kendrick |
| 239,805 | A | 4/1881 | Knapp |
| 319,083 | A | 6/1885 | Farrar |

(Continued)

FOREIGN PATENT DOCUMENTS

| | | | |
|---|---|---|---|
| CA | 2857823 | A1 | 1/2016 |
| CN | 2757674 | Y | 2/2006 |

(Continued)

OTHER PUBLICATIONS

Antique Victorian Hand Carved wood Fold-up Murphy Bed Chest Dresser, sold on ebay on Feb. 26, 2016, retrieved on Feb. 4, 2019, (https://www.ebay.com/itm/Antique-Victorian-Hand-Carved-wood-Fold-up-Murphy-Bed-Chest-Dresser-/281922985462?hash=item41a3eb5df6:g:ZhlAAOSwZd1Vb2Oa).

(Continued)

*Primary Examiner* — Peter M. Cuomo
*Assistant Examiner* — Ifeolu A Adeboyejo
(74) *Attorney, Agent, or Firm* — Harness, Dickey & Pierce, P.L.C.

(57) ABSTRACT

A folding bed chest device includes a chest and a sleeping platform. The chest is configured to store a foldable mattress and the sleeping platform when the folding bed chest device is in a folded position. The sleeping platform is configured to support a weight of the foldable mattress when the folding bed chest device is in an unfolded position.

14 Claims, 9 Drawing Sheets

(56) References Cited

U.S. PATENT DOCUMENTS

| | | | |
|---|---|---|---|
| 327,076 | A | 9/1885 | Farrar |
| 348,643 | A | 9/1886 | Strahan |
| 379,449 | A | 3/1888 | Condell |
| 394,688 | A | 12/1888 | Green |
| 445,777 | A | 2/1891 | Goodwillie |
| 474,587 | A | 5/1892 | Yeager |
| 791,857 | A | 6/1905 | Arnold |
| 1,170,149 | A | 2/1916 | Gustafson |
| 1,359,337 | A | 11/1920 | Culbertson |
| 1,757,068 | A | 5/1930 | Wikman |
| 2,356,321 | A | 8/1944 | Irick |
| 2,544,762 | A | 3/1951 | Lochridge |
| 2,577,741 | A | 12/1951 | Creveling |
| 3,638,249 | A | 2/1972 | Katsigarakis |
| 3,755,832 | A | 9/1973 | Bennett |
| 4,277,856 | A | 7/1981 | Danin |
| 4,793,011 | A | 12/1988 | Eve |
| 5,101,523 | A | 4/1992 | Bright |
| 5,353,452 | A | 10/1994 | Rulis |
| 5,440,768 | A | 8/1995 | Danin |
| 5,522,102 | A | 6/1996 | Vayda |
| 5,652,978 | A | 8/1997 | Wiig |
| 5,794,283 | A | 8/1998 | Vila et al. |
| 5,806,248 | A | 9/1998 | Kim |
| 6,088,849 | A | 7/2000 | Lieber |
| 6,463,603 | B1 | 10/2002 | Camfield |
| 6,851,139 | B2 | 2/2005 | Arason et al. |
| 7,574,758 | B2 | 8/2009 | Arason et al. |
| 8,006,327 | B1 | 8/2011 | Burchett |
| 8,572,776 | B2 | 11/2013 | Grubb |
| D712,676 | S | 9/2014 | Flora |
| D742,136 | S | 11/2015 | Flora |
| 9,468,305 | B2 | 10/2016 | Flora |
| 2006/0031986 | A1 | 2/2006 | Revels |
| 2006/0225210 | A1 | 10/2006 | Arason et al. |
| 2008/0264723 | A1 | 10/2008 | Tatum |
| 2016/0022048 | A1 | 1/2016 | Flora |

FOREIGN PATENT DOCUMENTS

| | | | |
|---|---|---|---|
| CN | 201557794 | U | 8/2010 |
| FR | 536132 | A | 4/1922 |
| FR | 953688 | A | 12/1949 |
| FR | 1084476 | A | 1/1955 |
| FR | 1589047 | A | 3/1970 |

OTHER PUBLICATIONS

Vintage Murphy bed, circa 1920s, Etsy photos, retrieved on Feb. 4, 2019, Sold on Dec. 22, 2018, (https://www.etsy.com/listing/630652228/vintage-murphybed?gpla=1&gao=1&&utm_source=google&utm_medium=cpc&utm_campaign=shopping_us_a-home_and_living-furniturebedroom_furniture-beds_and_headboards&utm_custom1=2e81fb16-fb6f-4098-96dc-34642e4931ca&utm_content=go_270948755_43325476758_194213642053_aud-301856855998:pla-308550201595_c_630652228&gclid=EAlalQobChMlubn6jcKL3wlVEZ7ACh3nzArREAkYliABEgLG6_D_BwE).

Invalidity Contentions of Defendant Atlantic Furniture, Inc. filed Dec. 19, 2018 in the United States District Court for the District of Massachusetts in Civil Action No. 3:18-CV-30104-KAR.

FURNITURE OBJECTS FOR STORING FOLDABLE BEDS

RELATED APPLICATIONS

This application is a continuation application of U.S. application Ser. No. 14/809,736, filed on Jul. 27, 2015, which claims priority under 35 U.S.C. § 119 to U.S. Provisional Application No. 61/999,876 filed on Aug. 8, 2014, the entire contents of each of which are hereby incorporated by reference in their entirety.

FIELD

The present disclosure relates generally to furniture objects configured to store foldable beds.

BACKGROUND

The statements in this section merely provide background information related to the present disclosure and may not constitute prior art.

Often, furniture apparatuses capable of more than one function are used in environments (e.g., residential, commercial, etc.) where space is limited. For example, futon beds or other like foldable beds may be used in such environments as sitting furniture (e.g., couches, sofas, etc.) and lying and/or sleeping furniture (e.g., beds, etc.). In these environments, futon beds may make more efficient use of the limited space and may relieve the need for additional furniture. However, even futon beds may take up too much space in certain environments.

SUMMARY

Example embodiments relate to a furniture object configured to store foldable beds.

Example embodiments relate to a chest, cabinet, coffer, trunk or other like furniture object configured to store a foldable bed.

At least one example embodiment relates to a chest configured to store a foldable bed.

According to one example embodiment, a chest is configured to be in one of an open position and a closed position. When the chest is in the closed position, the chest is configured to form an enclosure. When the chest is in the open position, the chest is configured to form a sleeping platform.

At least one example embodiment provides that in the closed position, the chest is configured to store a foldable mattress in the enclosure, the foldable mattress being in a folded position when being stored in the enclosure, and in the open position, the chest is configured to support the foldable mattress on the sleeping platform, the foldable mattress being in an unfolded position when being supported by the sleeping platform.

At least one example embodiment provides that the enclosure includes a front panel, a first side panel, a second side panel, a top panel, and a bottom section.

At least one example embodiment provides that the front panel is configured to be a portion of the sleeping platform when the chest is in the open position.

At least one example embodiment provides that the bottom section includes a removable piece, the removable piece configured to form a bottom enclosure when the removable piece is within the bottom section and the chest is in the closed position, and form a footboard when the removable piece is within the bottom section and the chest is in the open position.

At least one example embodiment provides that in the closed position, the removable piece includes a drawer, the drawer being configured to be drawn out horizontally when the removable piece is within to the bottom section.

At least one example embodiment provides that the first side panel includes a first sub-side panel and a second sub-side panel, the first sub-side panel is configured to connect to the second sub-side panel to form the first side panel, the first sub-side panel is connected to the front panel and the second sub-side panel is connected to the back panel; the second side panel includes a third sub-side panel and a fourth sub-side panel, and the third sub-side panel is configured to connect to the fourth sub-side panel to form the second side panel, the third sub-side panel is connected to the front panel and the fourth sub-side panel is connected to the back panel; and the top panel includes a first sub-top panel and a second sub-top panel, the first sub-top panel is configured to connect to the second sub-top panel to form the top panel, the first sub-top panel is connected to the front panel and the second sub-top is connected to the back panel.

At least one example embodiment provides that in the open position, the first sub-side panel is configured to detach from the second sub-side panel, the third sub-side panel is configured to detach from the fourth sub-side panel, and the first sub-top panel is configured to detach from the second sub-top panel; the first sub-side panel, the third sub-side panel, and the first sub-top panel are configured to support the weight of the sleeping platform; and the second sub-side panel, the fourth sub-side panel, and the second sup-top panel are configured to form a headboard.

At least one example embodiment provides that the first sub-side panel includes a first set of legs, each of the first set of legs being configured to support the weight of the sleeping platform in the open position, and at least one of (i) align the first sub-side panel with the second sub-side panel in the closed position, and (ii) connect the first sub-side panel to the second sub-side panel in the closed position, and the third sub-side panel includes a second set of legs, each of the second set of legs being configured to, support the weight of the sleeping platform in the open position, and connect the third sub-side panel to the fourth sub-side panel in the closed position.

At least one example embodiment provides that the first sub-top panel is configured to connect to the removable piece in the open position.

At least one example embodiment provides that in the open position, the removable piece is configured as a drawer such that that the removable piece is configured to be drawn out horizontally.

At least one example embodiment provides that in the open position, the first sub-top panel is configured to support the weight of the sleeping platform in a center portion of the sleeping platform.

At least one example embodiment provides that the front panel is connected to the bottom section via a hinge and the first sub-top panel is connected to the front panel via a hinge.

At least one example embodiment provides that a bottom section of the front panel is connected to the bottom section via a hinge and a top section of the front panel is connected to the first sub-top panel via a hinge.

At least one example embodiment provides that the front panel includes a set of slats, the set of slats being connected to the first sub-side panel, the third sub-side panel, and the top section of the front panel, and the front panel is configured as a foldable panel such that in the open position, the set of slats are configured to extend from the top section via the hinge between the top section and the first sub-top panel, and in the closed position, the set of slats are configured to be brought towards the front panel via the hinge between the top section and the first sub-top panel.

At least one example embodiment provides that in the closed position, the set of slats are enclosed in the enclosure, and in the open position, the set of slats and the front panel form the sleeping platform.

At least one example embodiment provides that in the open position, the removable piece is configured to form a footboard of the sleeping platform.

At least one example embodiment provides that the bottom section includes a removable piece and a set of rails, and the removable piece is configured to, in the closed position, form a bottom enclosure when the removable piece is within the bottom section, and in the open position, form a footboard when the removable piece is within the bottom section; and the set of rails are configured to, in the closed position, surround the bottom enclosure when the removable piece is within to the bottom section, and in the open position, support the weight of the sleeping platform.

At least one example embodiment provides that in the closed position, the removable piece is configured as a drawer such that that the removable piece is configured to be drawn out horizontally when the removable piece is within to the bottom section.

At least one example embodiment relates to a folding bed chest device.

According to an example embodiment, a folding bed chest device includes a chest and a sleeping platform; the chest being configured to store a foldable mattress and the sleeping platform when the folding bed chest device is in a folded position, the sleeping platform being configured to support a weight of the foldable mattress when the folding bed chest device is in an unfolded position, and the weight of the foldable mattress and a weight of the sleeping platform not being supported by telescoping rails.

Further areas of applicability will become apparent from the description and figures provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DESCRIPTION

Figure 1:
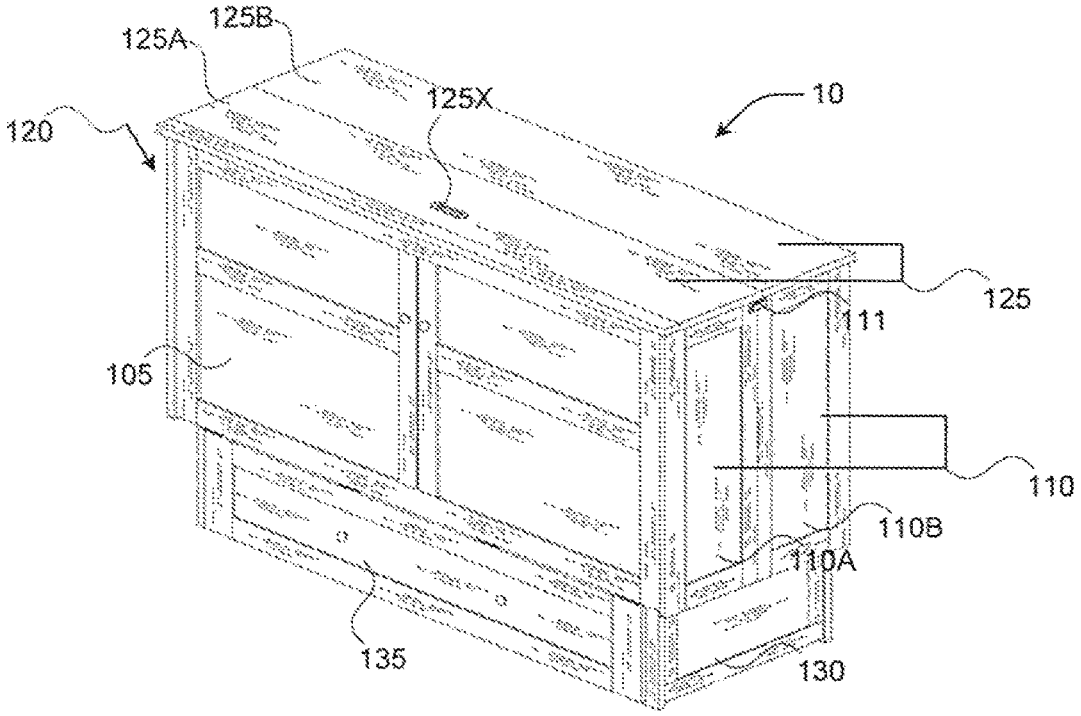
FIG. 1 is a front, left perspective view of a chest configured to store a foldable bed in a closed or folded position according to an example embodiment.

The following description is merely example in nature and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the concept of the invention to those skilled in the art.

Example embodiments relate to a furniture object configured to store a foldable bed. Example embodiments provide that the furniture object may be a chest, cabinet, coffer, trunk or any other like furniture object configured and/or adaptable to store a foldable bed. The furniture object described herein may be constructed, manufactured, or otherwise built in a variety of shapes include any rectangular shape, square shape, and/or any other like shape. The furniture objects described herein may be constructed, manufactured, or otherwise built using a variety of materials, such as wood, plastic, metal, minerals and/or any combination thereof.

Figure 2:
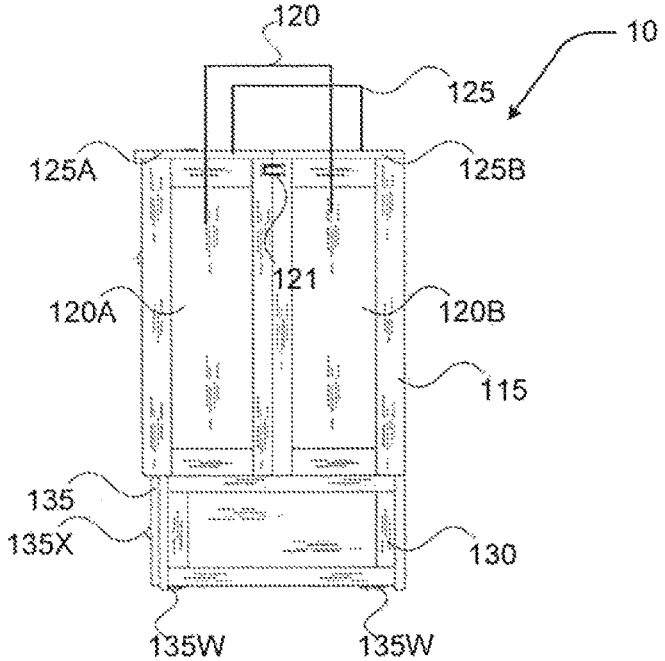
FIG. 2 is a side perspective view of a chest configured to store a foldable bed in a closed or folded position according to an example embodiment.
Figure 3:
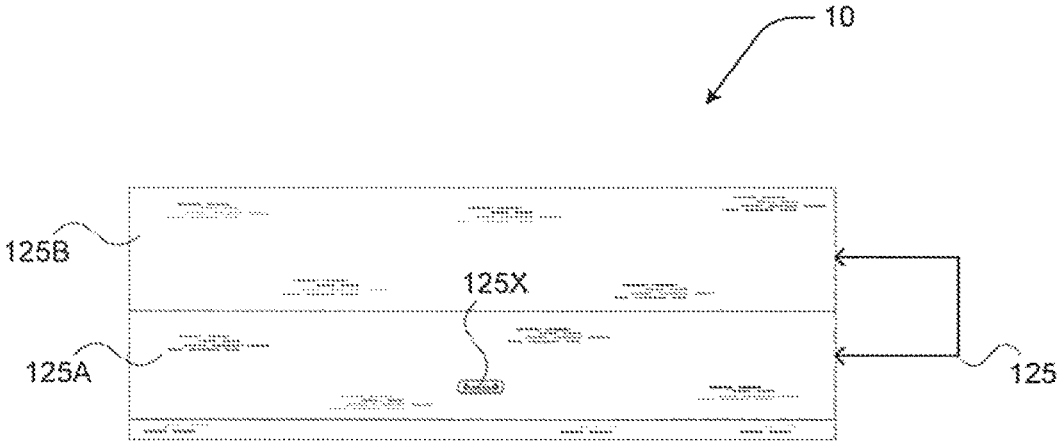
FIG. 3 is a top perspective view of a chest configured to store a foldable bed in a closed or folded position according to an example embodiment.
Figure 4:
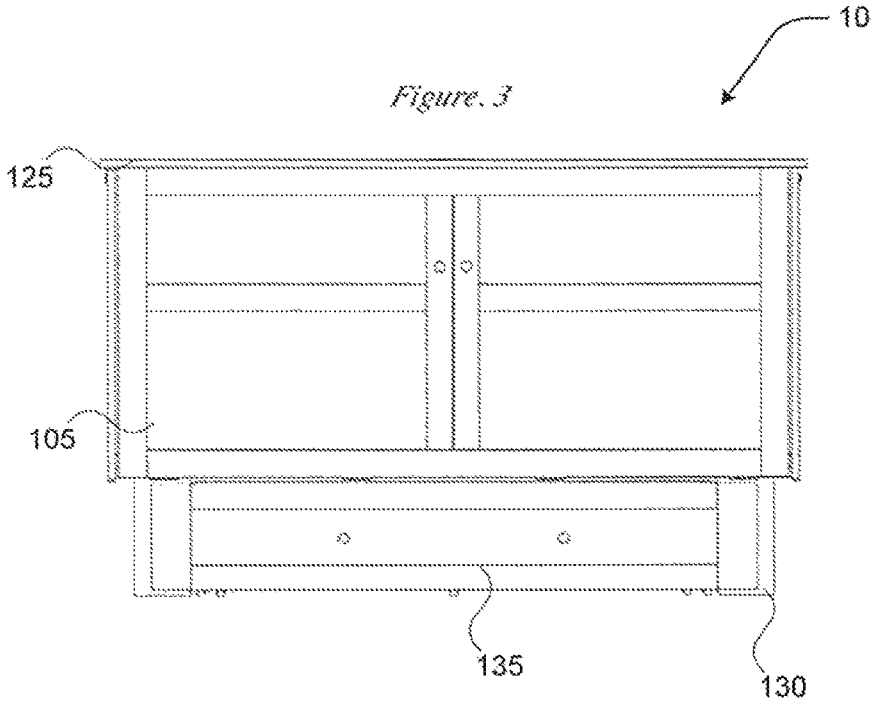
FIG. 4 is a front view a chest configured to store a foldable bed in a closed or folded position according to an example embodiment.

FIG. 1 is a front, left perspective view of a chest 10 configured to store a foldable bed 11 (also referred to as a foldable mattress 11) in a closed or folded position according to an example embodiment. FIG. 2 is a side perspective view of the chest 10 in a closed or folded position according to an example embodiment. FIG. 3 is a top perspective view of the chest 10 in the closed or folded position according to an example embodiment. FIG. 4 is a front view the chest 10 in the closed or folded position according to an example embodiment.

Referring to FIGS. 1-4, the chest 10 includes a front panel 105, a first side panel 110, a back panel 115, a second side panel 120, a top panel 125, and a bottom section 130. A bottom section of the front panel 105 is connected to the bottom section 130 via a hinge.

The first side panel 110 includes a first sub-side panel 110A and a second sub-side panel 110B. The first sub-side panel 110A is configured to connect to the second sub-side panel 110B to form the first side panel 110. The first sub-side panel 110A is connected to the front panel 105 and the second sub-side panel 110B is connected to the back panel 115.

The second side panel 120 includes a third sub-side panel 120A and a fourth sub-side panel 120B. The third sub-side panel 120A is configured to connect to the fourth sub-side panel 120B to form the second side panel 120. The third sub-side panel 120A is connected to the front panel 105 and the fourth sub-side panel 120B is connected to the back panel 115.

Figure 12:
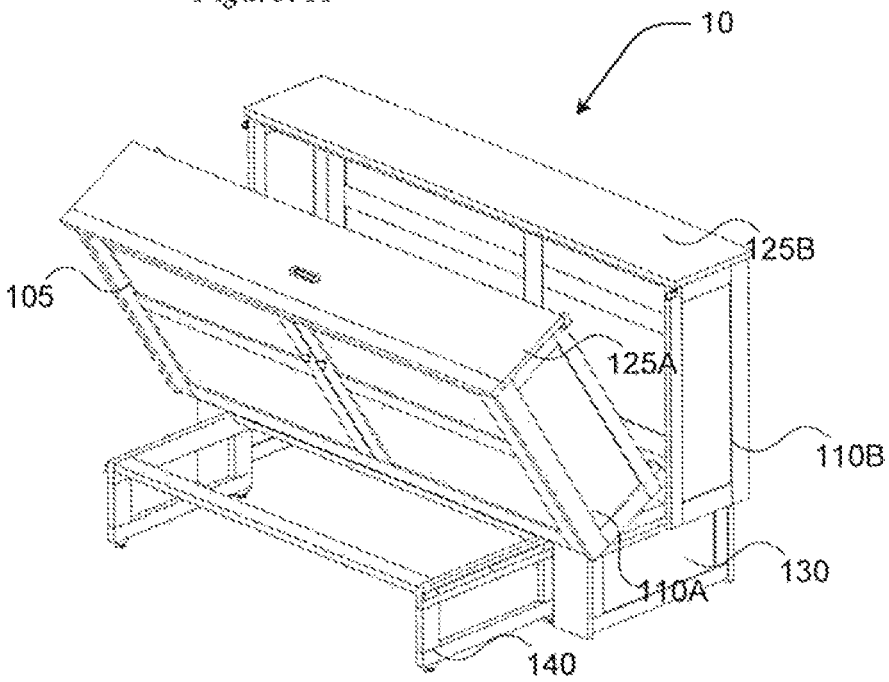

The first sub-side panel 110A, the second sub-side panel 110B, the third sub-side panel 120A, and/or the fourth sub-side panel 120B may include a latch 111, 121 and/or any other like mechanism that allows the sub-side panels to connect to one another as discussed above. Furthermore, the first sub-side panel 110A and the third sub-side panel 120A may include legs or other like protrusions (as shown in FIG. 12) that allows the first sub-side panel 110A to connect or otherwise attach to the second sub-side panel 110B and allows the third sub-side panel 120A to connect or otherwise attach to the fourth sub-side panel 120B. When the chest 10 is in the open position, the legs or other like protrusions may support the sleeping platform 200.

The top panel 125 includes a first sub-top panel 125A and a second sub-top panel 125B. The first sub-top panel 125A is configured to connect to the second sub-top panel 125B to form the top panel 125. The first sub-top panel 125A is connected to the front panel 105 and the second sub-top panel 125B is connected to the back panel 115. The first sub-top panel 125A may include one or more handles 125X. Handles 125X may be any type of handle, knob, latch, hook, and/or any other like protrusion that facilitates the first sub-top panel 125A to be detached from the second sub-top panel 125B thereby allowing the chest 10 to transition from the closed position to the open position. In some embodiments, first sub-top panel 125A may include any another type of mechanism by which to manipulate the first sub-top panel 125A, including one or more holes cut into the first sub-top panel 125A, a hollowed-out area to insert a user's fingers into the first sub-side panel 110A, and the like.

The bottom section 130 may include a removable piece 135. When the chest 10 is in the closed position and the removable piece is within the bottom section, the removable piece 135 is configured to form a bottom enclosure. In various embodiments, the removable piece 135 is configured as a drawer 135A, the front face of which is shown in FIGS. 1-4. The drawer 135A is configured to be drawn out horizontally when the removable piece 135 is within the bottom section 130. The drawer 135A is configured to roll on rollers when the chest 10 is transitioned from the closed position to an open position (also referred to as an unfolded position). The drawer 135A may include one or more handles 135X. Handles 135X may be any type of handle, knob, latch, hook, and/or any other like protrusion that facilitates the drawer 135A to be drawn out horizontally thereby allowing the chest 10 to transition from the closed position to the open position. In some embodiments, drawer 135A may include any another type of mechanism by which to open the drawer 135A, including holes cut in the front face of the drawer 135A, a hollowed-out area to insert a user's fingers into the front face of the drawer 135A, and the like.

It should be noted that the removable piece 135 may be considered an optional component of the chest 10.

As discussed below with reference to FIGS. 5-18, the bottom section 130 includes a set of rails 140 that support the front panel 105. When the chest 10 is in the closed position, the set of rails 140 surround the bottom enclosure when the removable piece 135 is within the bottom section 130. When the chest 10 is in the open position (as discussed with regard to FIGS. 5-8), the rails 140 support the weight of the sleeping platform 200. The set of rails 140 may or may not be telescoping rails, such that the set of rails 140 slide in/out of the bottom section 130. It should be noted that according to various embodiments, the set of rails 140 are not telescoping rails.

The chest 10 in the closed position is configured to store a foldable mattress 11 in an enclosure formed by the front panel 105, the first side panel 110, the back panel 115, the second side panel 120, the top panel 125, and the bottom section 130. The foldable mattress 11 is in a folded position when being stored in the enclosure formed by the front panel 105, the first side panel 110, the back panel 115, the second side panel 120, the top panel 125, and the bottom section 130.

Figure 5:
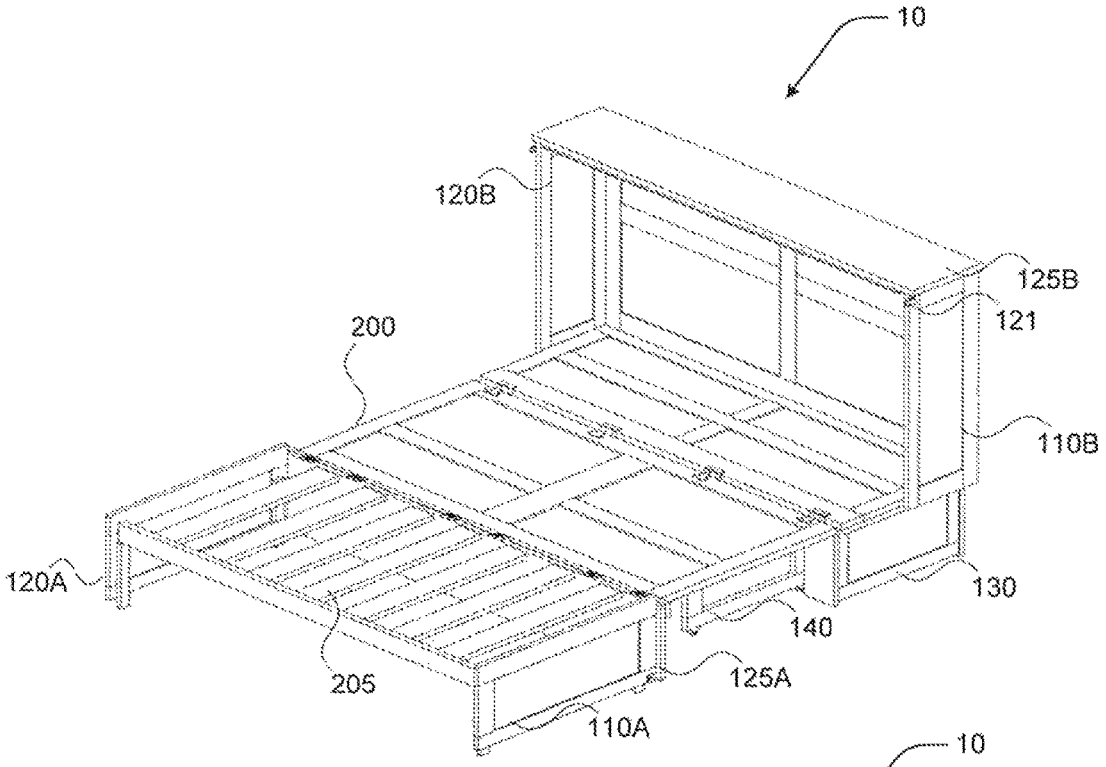
FIG. 5 is a front, left perspective view of a chest configured to store a foldable bed in an open and unfolded position according to an example embodiment.
Figure 6:
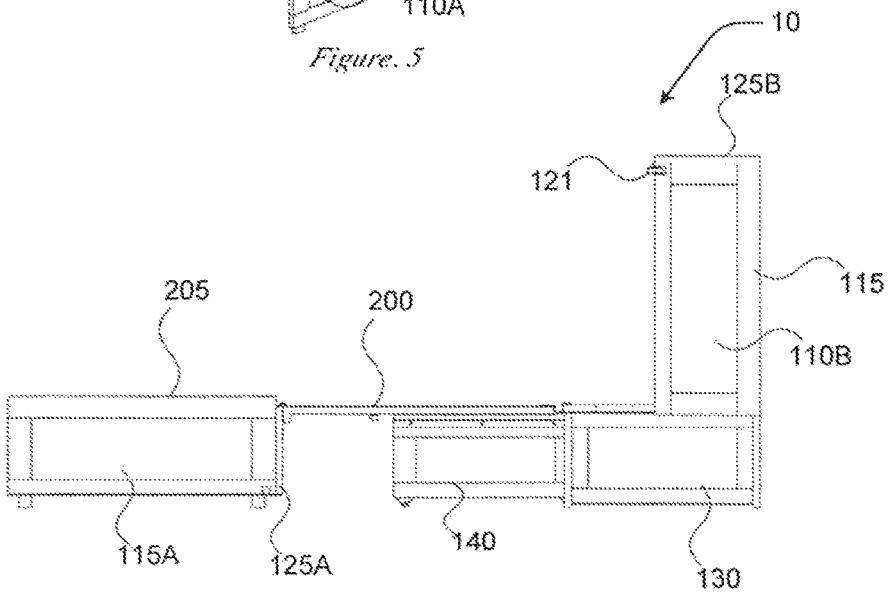
FIG. 6 is a side perspective view of a chest configured to store a foldable bed in an open and unfolded position according to an example embodiment.
Figure 7:
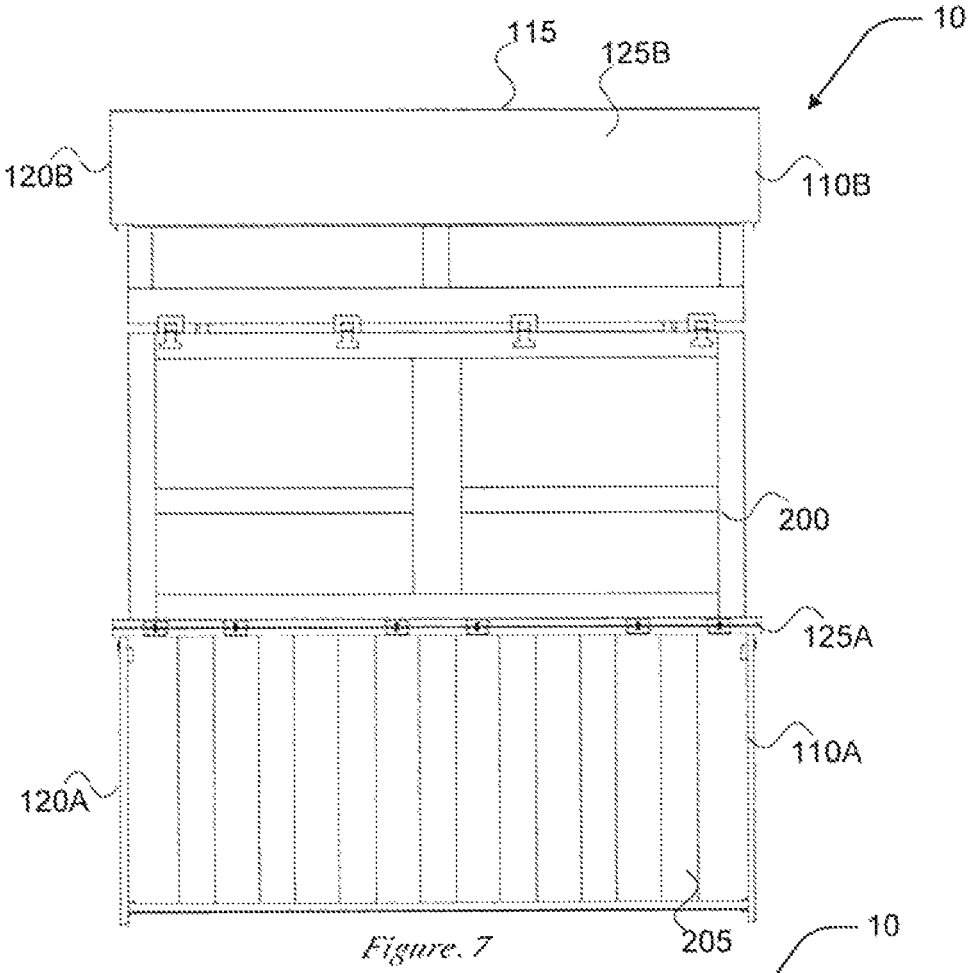
FIG. 7 is a top perspective view of a chest configured to store a foldable bed in an open and unfolded position according to an example embodiment.
Figure 8:
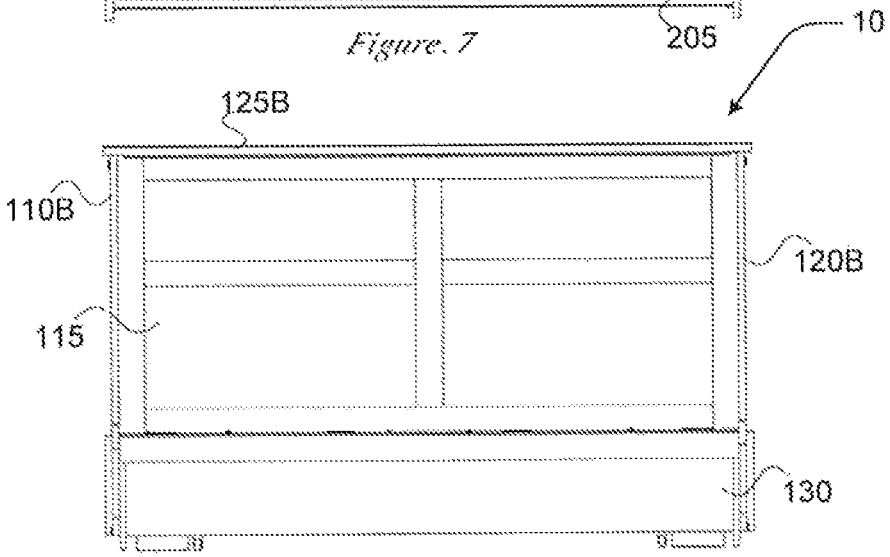
FIG. 8 is a back view a chest configured to store a foldable bed in an open and unfolded position according to an example embodiment.

FIG. 5 is a front, left perspective view of the chest 10 in the open and/or unfolded position according to an example embodiment. FIG. 6 is a side perspective view of the chest 10 in the open and/or unfolded position according to an example embodiment. FIG. 7 is a top perspective view of the chest 10 in the open and/or unfolded position according to an example embodiment. FIG. 8 is a back view the chest 10 in the open and/or unfolded position according to an example embodiment.

When the chest 10 is in the open and/or unfolded position, the first sub-side panel 110A detaches from the second sub-side panel 110B, the third sub-side panel 120A detaches from the fourth sub-side panel 120B, and the first sub-top panel 125A is configured to detach from the second sub-top panel 125B. The first sub-side panel 110A, the third sub-side panel 120A, and the first sub-top panel 125A are configured to support the weight of a sleeping platform 200. In this regard, the first sub-side panel 110A, the third sub-side panel 120A, and the first sub-top panel 125A may be considered to be, or otherwise act as "legs" and/or any other like support mechanism for the sleeping platform 200. The second sub-side panel 110B, the fourth sub-side panel 120B, and the second sup-top panel 125B are configured to form a headboard for the sleeping platform 200.

When the chest 10 is in the open and/or unfolded position and the removable piece 135 is a drawer, the removable piece 135 is configured to be drawn out horizontally.

The front panel 105 includes a set of slats 205. The set of slats 205 are connected to the first sub-side panel 110A and the third sub-side panel 120A. The first sub-top panel 125A is connected to the slats 205 via a hinge. When the chest 10 is in the closed position, the set of slats 205 are enclosed in the enclosure formed by the front panel 105, the first side panel 110, the back panel 115, the second side panel 120, the top panel 125, and the bottom section 130. When the chest 10 is in the open position, the set of slats 205 and the front panel 105 form the sleeping platform that supports the foldable mattress 11. Furthermore, in various embodiments, the removable piece 135 is configured to form a footboard of the sleeping platform 200.

When the chest 10 is in the open and/or unfolded position, the first sub-top panel 125A is configured to support the weight of the sleeping platform 200 in a center portion of the sleeping platform 200. The front panel 105 is connected to the bottom section 130 via a hinge and the first sub-top panel 125A is connected to the front panel 105 via a hinge. A bottom section of the front panel 105 is connected to the bottom section 130 via a hinge and a top section of the front panel 105 is connected to the first sub-top panel 125A via a hinge. According to various embodiments, the front panel 105 is a foldable panel such that when the chest 10 transitions from the closed position to the open position, the set of slats 200 are configured to extend from the top section of the front panel 105 via the hinge between the top section of the front panel 105 and the first sub-top panel 125A, and when the chest 10 transitions from the open position to the closed position, the set of slats 200 are configured to be brought towards the front panel 105 via the hinge between the top section of the front panel 105 and the first sub-top panel 125A.

Figure 9:
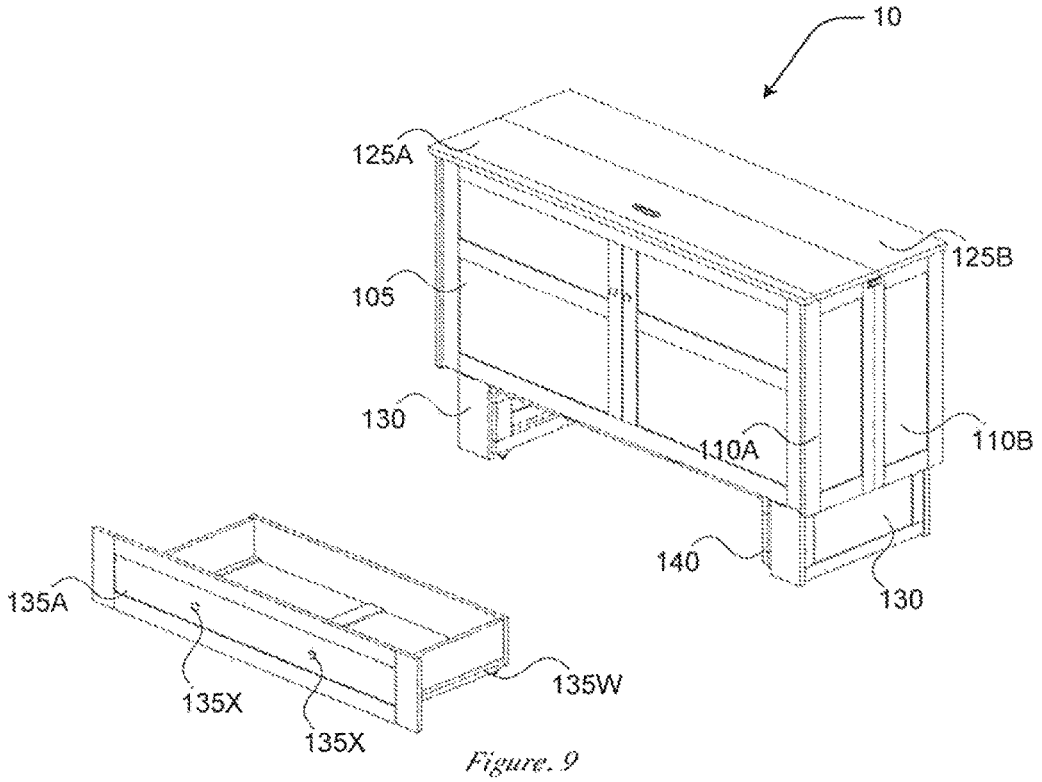
FIG. 9 is a front, left perspective view of a chest configured to store a foldable bed with a detached movable drawer according to an example embodiment according to an example embodiment.
Figure 10:
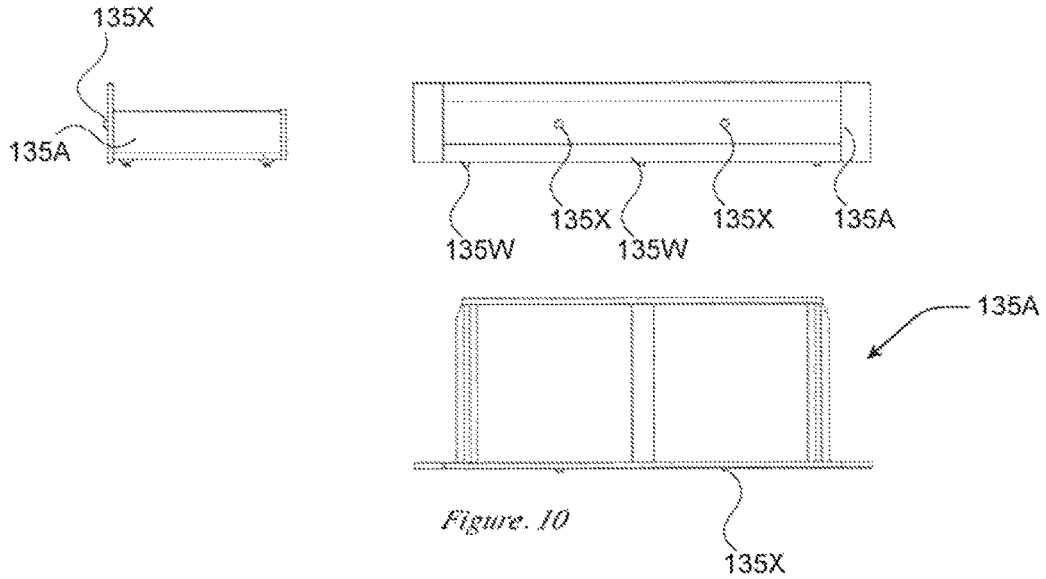
FIG. 10 is a side, front, and top perspective view of the movable drawing of FIG. 9.

FIG. 9 is a front, left perspective view of a chest configured to store a foldable bed with a detached movable drawer 135A according to an example embodiment. FIG. 10 is a side, front, and top perspective view of the movable drawer 135A of FIG. 9 according to an example embodiment.

The drawer 135A may be any container that fits into a piece of furniture (e.g., chest 10), and/or any other like object. In various embodiments, the drawer 135A may be designed such that a front face of the drawer 135A is flush with, or otherwise aligned with the side sections of the bottom section 130 when the drawer 135A is in a closed position or otherwise received by the bottom section 130.

The drawer 135A is configured to be drawn out horizontally from the bottom section 130 when the chest 10 transitions from the closed position to the open position. In the open position, a user of the chest 10 may place objects inside the drawer 135A. In order to transition from the closed position to the open position (and vice versa), as shown in FIGS. 9-10, the drawer 135A may include one or more wheels 135W to allow the drawer 135A to be rolled across a floor that supports the drawer 14A and the chest 10 when transitioning the chest 10 into the open position from the closed position.

Alternatively, in other example embodiments, the bottom section 130 may include sliders (not shown) upon which the drawer 135A slides as it is transitioned from the open position to the closed position and vice versa. The sliders may be friction sliders, ball-bearing sliders, roller-bearing sliders, progressive action slides, and/or any other like apparatus and/or mechanism that enables the drawer 135A to be drawn out and/or pushed in a substantially horizontal fashion. The sliders may be located within the enclosure formed by the bottom section 130 and/or the sliders may be attached to the drawer 135A. Additionally, the sliders and/or runners may be configured to allow the drawer 135A to detach/attach to the bottom section 130 such that the drawer 135A can be removed/inserted into the enclosure formed by the bottom section 130. It should also be noted that the drawer 135A may be placed in an open position using any other type of manipulation in addition to (or alternative to) a drawing-out motion.

FIGS. 11-18 show a method for placing the chest configured to store a foldable bed into an open and unfolded position according to an example embodiment.

Figure 11:
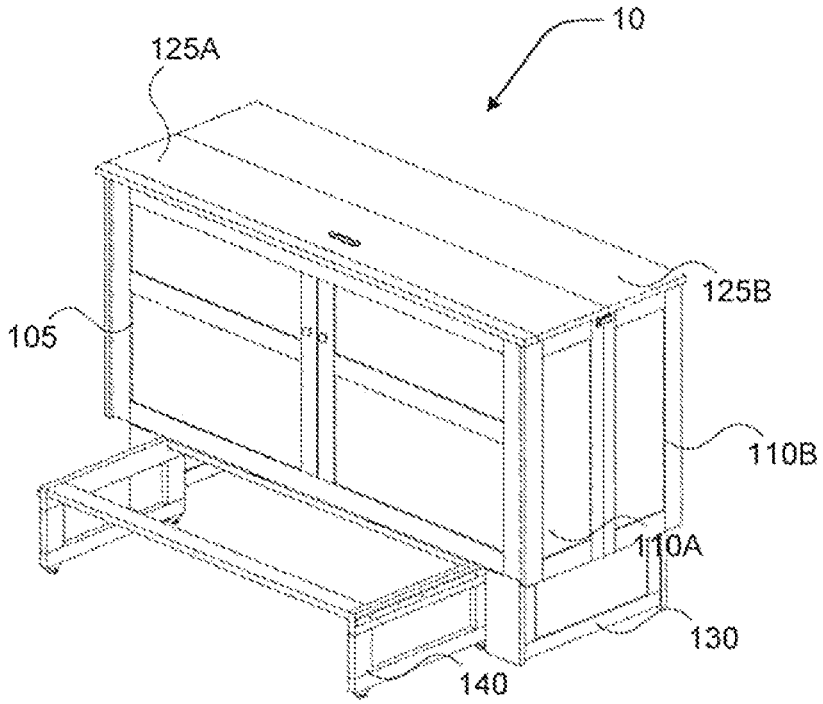
FIGS. 11-18 show a method for placing the chest configured to store a foldable bed into an open and unfolded position according to an example embodiment.

Referring to FIG. 11, the set of rails 140 may be drawn out horizontally.

Figure 13:
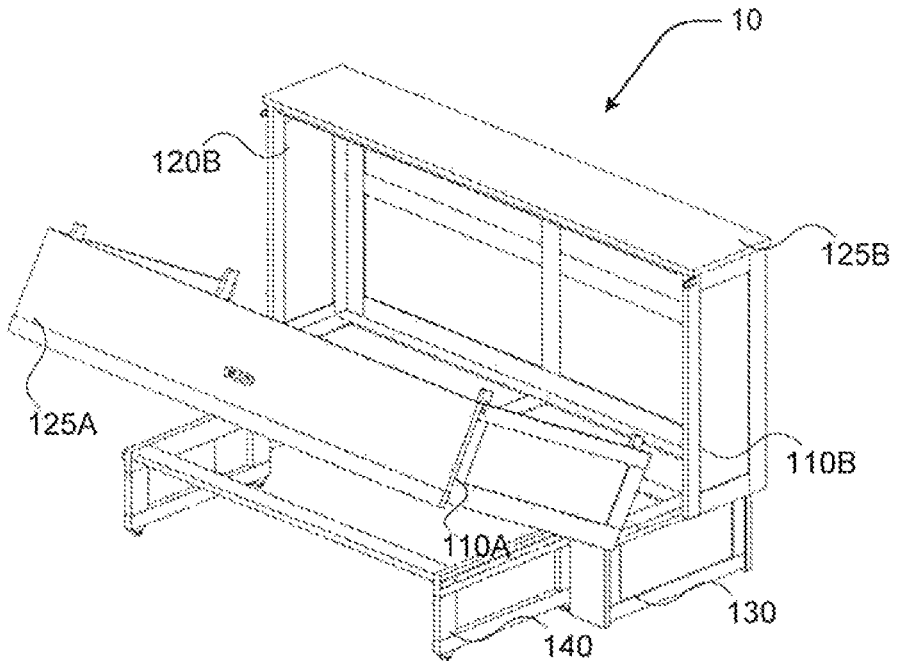

Referring to FIGS. 12-13, the first sub-side panel 110A disconnects or otherwise detaches from the second sub-side panel 110B, the third sub-side panel 120A disconnects or otherwise detaches from the fourth sub-side panel 120B, and the first sub-top panel 125A disconnects or otherwise detaches from the second sub-top panel 125B. The front panel 105 is hingedly connected to the bottom section 130, which allows the front panel 105 including the first sub-side panel 110A, the third sub-side panel 120A, and the first sub-top panel 125A to fold away from the back panel 115 including the second sub-side panel 110B, the fourth sub-side panel 120B, and the second sub-top panel 125B.

Figure 14:
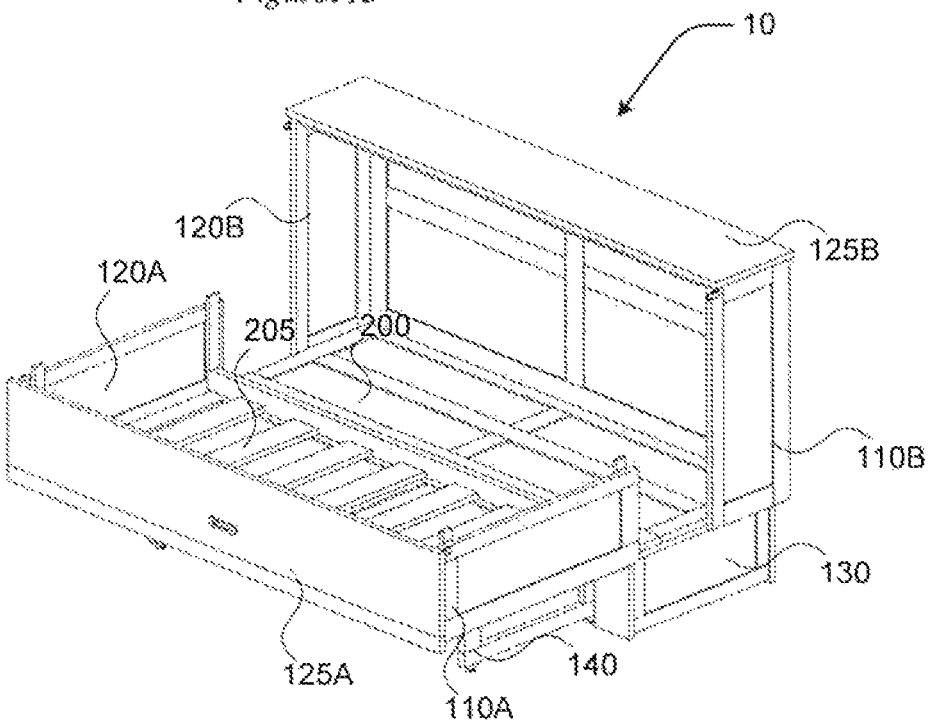
Figure 15:
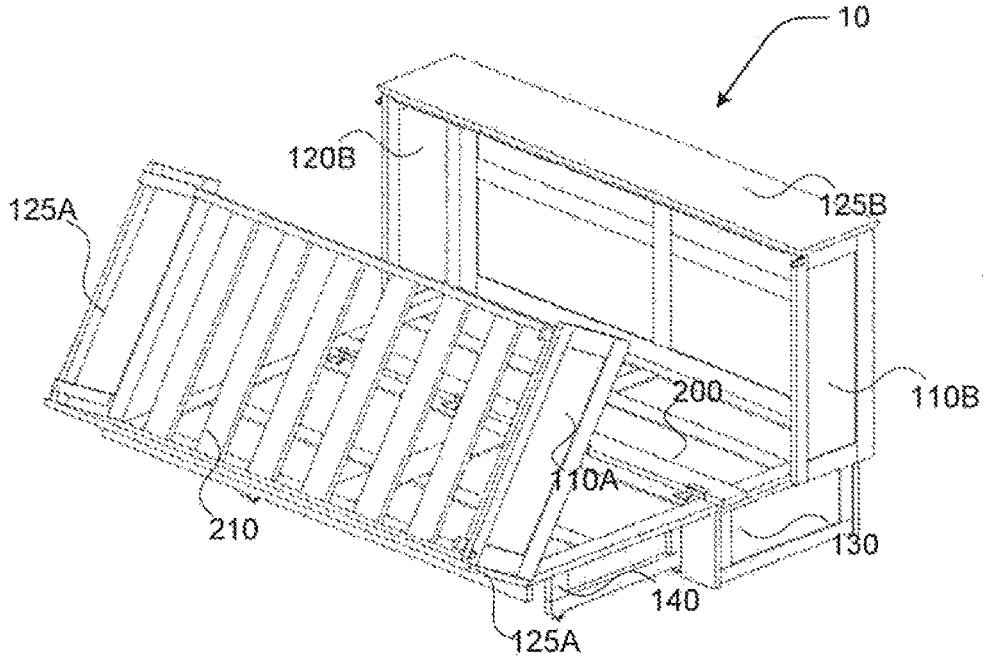
Figure 16:
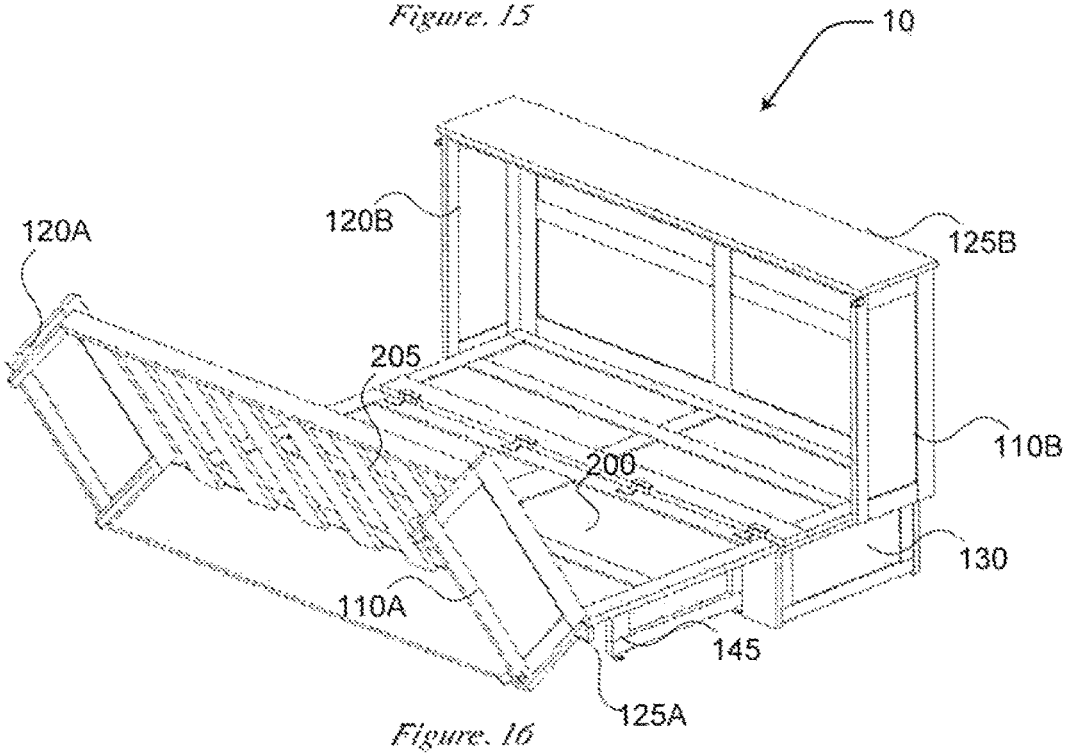
Figure 17:
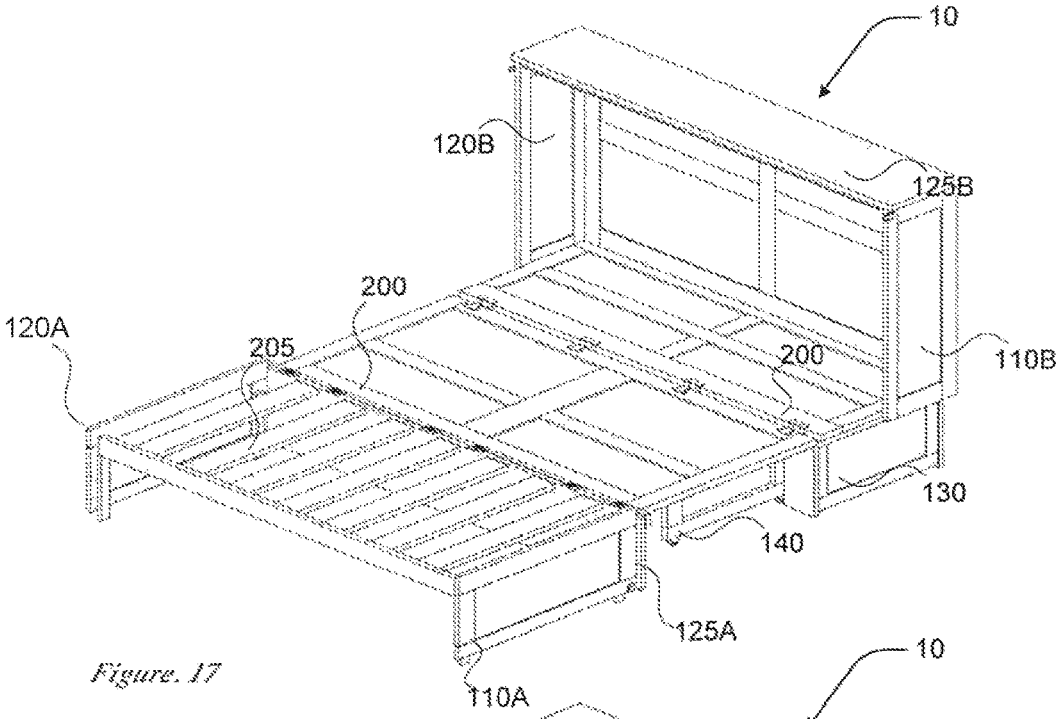

Referring to FIG. 14, when the front panel including the first sub-side panel 110A, the third sub-side panel 120A, and the first sub-top panel 125A is unfolded, the front panel 105 may rest on the set of rails 140.

Referring to FIGS. 14-17, the set of slats 200 are unfolded from the front panel 105 via a hinge that connects the first sub-top panel 125 to the set of slats 200. Once unfolded, the first sub-side panel 110A, the third sub-side panel 120A, and the first sub-top panel 125A rest on a floor. When resting on the floor, the first sub-side panel 110A, the third sub-side panel 120A, the first sub-top panel 125A, and the floor form an enclosure that is configured to receive the drawer 135A.

Figure 18:
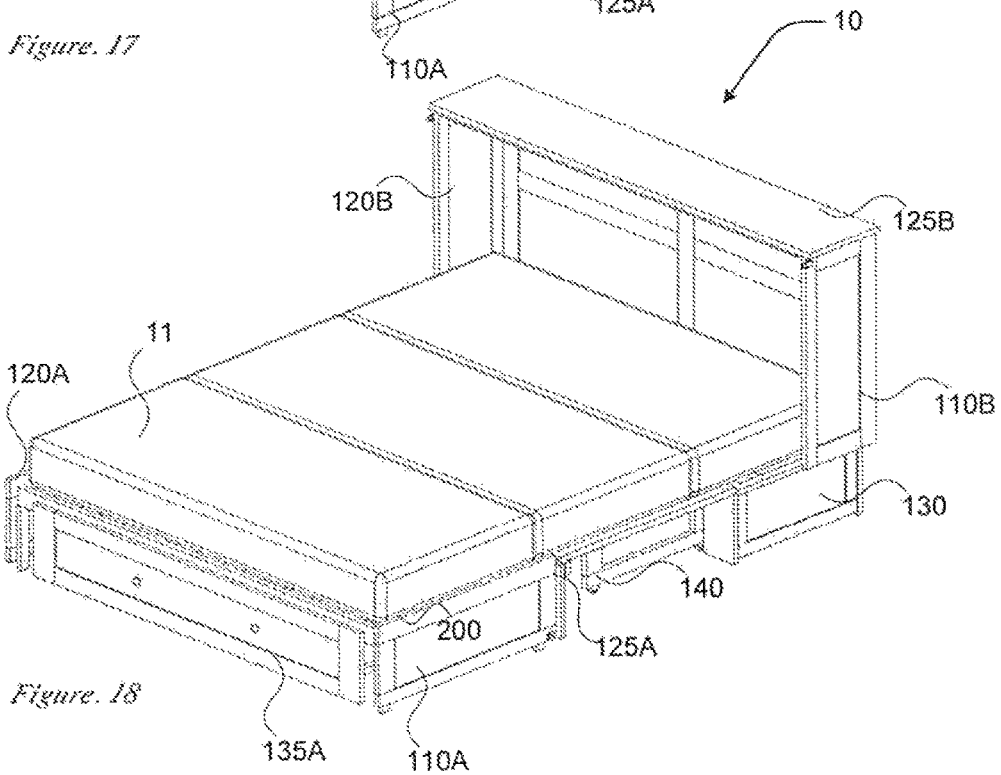

Referring to FIG. 18, the drawer 135A is inserted into the enclosure formed by the first sub-side panel 110A, the third sub-side panel 120A, the first sub-top panel 125A, and the floor. Additionally, the foldable mattress 11 is placed on the sleeping platform 200.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A chest configured to transition between an open position and a closed position, the chest comprising:

a front panel, a first side panel, a second side panel, a top panel, and a bottom section, the front panel including a first section and a second section hingably connected together, the first side panel including a first sub-side panel and a second sub-side panel, the second side panel including a third sub-side panel and a fourth sub-side panel, the top panel including a first sub-top panel and a second sub-top panel, the first sub-top panel connected to the second section of the front panel, and the second section of the front panel being connected to the first sub-side panel and the third sub-side panel such that the second section of the front panel, the first sub-side panel and the third sub-side panel move together when the chest transitions between the open position and the closed position, wherein in the closed position, the first section of the front panel, the first side panel, the second side panel, the top panel, and the bottom section are configured to form an enclosure with the second section of the front panel and a foldable mattress hidden therein, and in the open position, the chest is configured to form a sleeping platform by twice unfolding the second section of the front panel such that the first sub-top panel, the first sub-side panel and the third sub-side panel are oriented vertically from the sleeping platform towards a ground.

2. The chest of claim 1, wherein the first sub-side panel and the third sub-side panel each include legs connected thereto, and in the open position, the first sub-side panel and the third sub-side panel are oriented vertically from the sleeping platform towards the ground in support of the sleeping platform.

3. The chest of claim 1, wherein the first sub-side panel and the third sub-side panel each include legs connected thereto, and in the open position, the first sub-side panel and the third sub-side panel are oriented vertically from the sleeping platform towards the ground such that the legs at least assist in supporting the sleeping platform.

4. The chest of claim 3, wherein the first sub-side panel and the third sub-side panel each include a facade and the legs attached thereto such that, in the open position, the legs extend downward beyond the facade and contact the ground.

5. A folding bed chest device comprising:

a chest including a front panel, a first side panel, a second side panel, a top panel, and a bottom section, the front panel including a first section and a second section hingably connected together, the first side panel including a first sub-side panel and a second sub-side panel, the second side panel including a third sub-side panel and a fourth sub-side panel, the top panel including a first sub-top panel and a second sub-top panel, the first sub-top panel connected to the second section of the front panel, and the second section of the front panel being connected to the first sub-side panel and the third sub-side panel such that the second section of the front panel, the first sub-side panel and the third sub-side panel move together when the folding bed chest device transitions between an unfolded position and a folded position, wherein when the folding bed chest device is in the folded position, the chest is configured to store a foldable mattress and a sleeping platform in an enclosure formed by the first section of the front panel, the first side panel, the second side panel, the top panel, and the bottom section with the second section of the front panel and the foldable mattress hidden therein, and when the folding bed chest device is in the unfolded position, the sleeping platform is formed by twice unfolding the second section of the front panel such that the first sub-top panel, the first sub-side panel and the third sub-side panel are oriented vertically from the sleeping platform towards a ground.

6. The folding bed chest device of claim 5, wherein the first sub-side panel and the third sub-side panel each include legs connected thereto, and in the unfolded position, the first sub-side panel and the third sub-side panel are oriented vertically from the sleeping platform towards the ground in support of the sleeping platform.

7. The folding bed chest device of claim 5, wherein the first sub-side panel and the third sub-side panel each include legs connected thereto, and in the unfolded position, the first sub-side panel and the third sub-side panel are oriented vertically from the sleeping platform towards the ground such that the legs at least assist in supporting the sleeping platform.

8. The folding bed chest device of claim 7, wherein the first sub-side panel and the third sub-side panel each include a facade and the legs attached thereto such that, in the unfolded position, the legs extend downward beyond the facade and contact the ground.

9. The chest of claim 1, wherein the first section of the front panel is hingably connected to the bottom section, a side surface of the first sub-side panel and a side surface of the third sub-side panel are configured to abut the bottom section when the chest is in the closed position, and the first sub-top panel is configured to abut the second sub-top panel to form the top panel when the chest is in the closed position.

10. The chest of claim 9, wherein, while the chest is transitioning from the closed position to the open position, the first sub-side panel and the third sub-side panel are configured to disjoin from the bottom section while the second sub-side panel and the fourth sub-side panel remain stationary with respect to the bottom section.

11. The chest of claim 1, wherein, when the chest is in the open position, the chest is configured to form the sleeping platform such that the sleeping platform includes at least an upper surface of the bottom section, an upper surface of the first section of the front panel and an upper surface of the second section of the front panel with respect to the ground.

12. The folding bed chest device of claim 5, wherein the first section of the front panel is hingably connected to the bottom section, a side surface of the first sub-side panel and a side surface of the third sub-side panel are configured to abut the bottom section when the chest is in the folded position, and the first sub-top panel is configured to abut the second sub-top panel to form the top panel when the chest is in the folded position.

13. The folding bed chest device of claim 12, wherein, while the chest is transitioning from the folded position to the unfolded position, the first sub-side panel and the third sub-side panel are configured to disjoin from the bottom section while the second sub-side panel and the fourth sub-side panel remain stationary with respect to the bottom section.

14. The folding bed chest device of claim 5, wherein, when the chest is in the unfolded position, the chest is configured to form the sleeping platform such that the sleeping platform includes at least an upper surface of the bottom section, an upper surface of the first section of the front panel and an upper surface of the second section of the front panel with respect to the ground.

* * * * *